United States Patent [19]

Jones

[11] Patent Number: 4,531,303

[45] Date of Patent: Jul. 30, 1985

[54] PRISMATIC STRAIGHTEDGE

[76] Inventor: Michael J. Jones, 1444 Burton Ave., Lutherville, Md. 21093

[21] Appl. No.: 645,347

[22] Filed: Aug. 28, 1984

[51] Int. Cl.[3] ..... B43L 7/00

[52] U.S. Cl. ..... 33/483; 33/488

[58] Field of Search ..... 33/403, 483, 488, 493, 33/41 R

[56] References Cited

U.S. PATENT DOCUMENTS

| | | | |
|---|---|---|---|
| 1,800,452 | 4/1931 | Karnasch | 50/286 |
| 1,907,873 | 5/1933 | Richards et al. | 356/150 |
| 2,248,758 | 7/1941 | Higgonnet et al. | 350/287 |
| 2,547,745 | 4/1951 | Cade et al. | 33/403 |
| 2,799,938 | 7/1957 | Anderson | 33/483 |
| 2,908,081 | 10/1959 | Burke, Jr. | 33/488 |
| 3,393,034 | 7/1978 | Imai | 350/360 |

FOREIGN PATENT DOCUMENTS

| | | | |
|---|---|---|---|
| 832262 | 8/1954 | Fed. Rep. of Germany | 33/403 |
| 861111 | 9/1981 | U.S.S.R. | 33/403 |

*Primary Examiner*—Willis Little

*Attorney, Agent, or Firm*—John F. McClellan, Sr.

[57] ABSTRACT

A drafting instrument includes a plurality of transparent prism arrays, each array including a plurality of transparent prisms juxtaposed in parallel relation and fixed at a predetermined angular relation to a straightedge on top of which the bases of the prisms rest. The preferred predetermined angular relations are: 30°, 45° and parallel, to the straightedge. When viewed through the prism arrays, portions of lines not perpendicular thereto, appear offset, providing a way to establish perpendicularity and specific alignment between line and straightedge by re-orientation of the drafting instrument. The straightedge is made substantially thicker than required for structural strength, to enhance the offset appearance of lines viewed through the prism and thus increase sensitivity of offset indication. The straightedge preferably has two edges on opposite sides and parallel with each other. In the preferred construction the prisms and straightedge are made as a unit and protected by a transparent cover.

14 Claims, 7 Drawing Figures

PRISMATIC STRAIGHTEDGE

FIELD OF THE INVENTION

This invention relates generally to drafting instruments and specifically to a combined instrument that performs the functions of a "T"-square, selected triangles, and a parallel rule.

BACKGROUND OF THE INVENTION

In the known art is a device disclosed in U.S. Pat. No. 1,907,873 issued to O. W. Richards and Percy M. Roppe on 5-9-33, in which a transparent prism was mounted to a holder rotatably with respect to fiducial markings on a transparent plate so as to provide means for establishing tangents to arcs.

Also known are the following U.S. Pat. Nos.:

1,800,452 issued to L. M. Karnasch on Apr. 14, 1931, disclosed prism-defining edge contour structure in drawing implements.

2,248,758 to R. A. Higgonnet and R. M. Jucas, July 8, 1941 and 3,393,034 to S. Imai, July 16, 1978, are included to show multiple prisms that would be useful in such applications as the present invention.

SUMMARY OF THE INVENTION

The instrument of this invention in a preferred embodiment can perform the functions of a straightedge, a T-square, a 30-60-90 triangle and a 45-45-90 triangle and a parallel rule.

The invention provides for each function a substantially large viewing area composed of a plurality of elongated prisms in an array with the long axes of the vertex angle of each elongated prism substantially parallel, and a drawing guide or straightedge, running the entire length of the instrument. Multiple breaks appear in a view reference line when misaligned relative to the intended, pre-set angle, serving to make placement and use of the instrument more positive and with greater speed and confidence in alignment.

Also provided is a means of raising the plane, in which the bases of the prisms lie, above the surface of the work to be viewed, to enhance the optical refractive effect of the prism by causing the reference line to appear broken not only at the vertex angle of the prism but also at the base angles. A viewed reference thereby appears to break into two or more lines completely separated from the reference, if the alignment is not correct.

An area of prisms as described but with the vertex angles of said viewing device permanently aligned to an angle of 45 degrees with respect to the drawing edge of said instrument provides for the construction of 45 degree lines to a reference and, in combination of use with an array of prisms aligned parallel to the drawing edge, can be used to draw such 45 degree angles in any quadrant of the drawing surface.

Also provided is a viewing area of prisms as described above but with 30 degree prism alignment (or optionally with 60 degree alignment) to the drawing edge. In combination with use of the 90 degree section, either of these may be used, to draw both 30 degree or 60 degree angles to a reference line in any quadrant of the drawing surface.

There are no moving parts, none being required for the device to function to its fullest capacity.

The function of the instrument is independent of any fiducial markings, thereby increasing the speed and ease of use, the only requirement being ability to see the work through a substantially large viewing area.

The instrument, except for the enclosing top, will be found to lend itself to manufacture as a one piece plastic moulding thereby reducing the manufacturing cost. Even an optional enclosed top would not increase the cost significantly.

No instrument is known to have become a standard of commerce for the purposes intended for the present invention, and to provide such is an object of this invention.

Further objects are to provide a system of straightedge, and transparent prisms in fixed relation to each other, that avoids need for relatively moving parts in indicating, by the appearance of line offset, angular relations of straightedge to lines known and those to be drawn and otherwise established.

Still a further object is to provide a system as described with means to enhance the appearance of line offset and increase the sensitivity of indication.

And further objects are to provide in a single optical drawing instrument the ability to perform functions normally performed by mechanical implements such as T-squares and triangles.

And still further objects are to provide a system as described that is economical, efficient, durable, simple to use, reliable, compact and handsome in appearance.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION OF DRAWINGS

Figure 1:
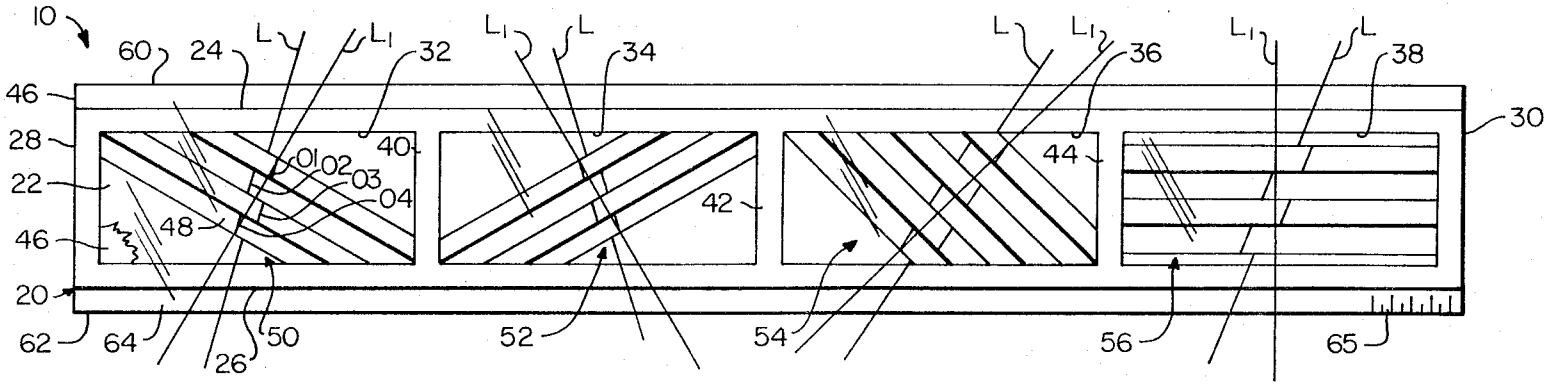
FIG. 1 is a plan view of a preferred embodiment in use.
Figure 2:
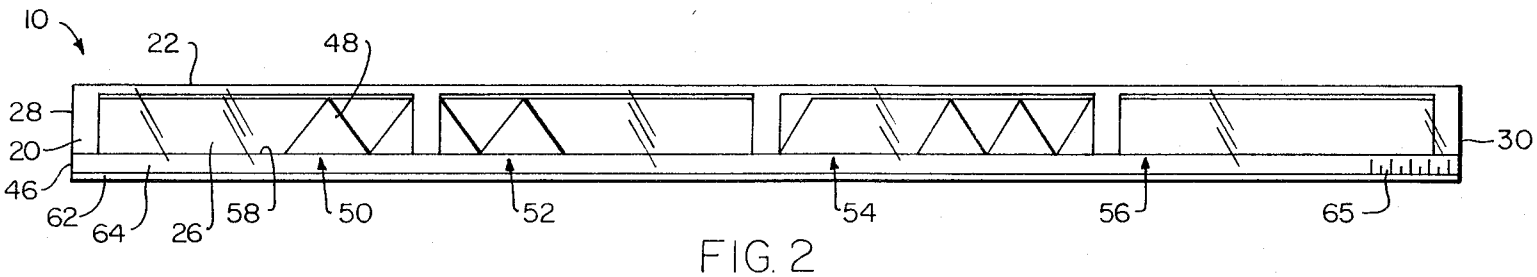
FIG. 2 is a side elevational view thereof.
Figure 3:
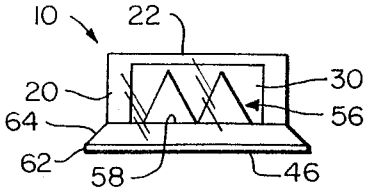
FIG. 3 is an end elevational view.

FIGS. 1, 2 and 3 show the invention in embodiment 10. Frame 20 is generally rectangular, may have a transparent top 22, and preferably transparent sides 24, 26 and ends 28, 30. The space enclosed by the frame may be divided into four equal spaces 32, 34, 36, 38 by three transverse walls 40, 42, 44 and the ends 28, 30 that are transverse also. More or fewer arrays may be used.

The bottom of the frame may rest on a transparent planar member 46, with which it may be integral, enclosing the spaces 32, 34, 36, 38. Within each space is a respective prism apparatus. This may be in the form of a single prism in each space. However, a plurality of prisms 48 in parallel alignment with bases in a plane, forming a respective array of one of 50, 52, 54, 56 in each space, is preferred.

The prisms 48 may be symmetrical oblique triangular prisms. Preferably all prisms are similar. For reasons that will be explained, the bases of the prisms preferably rest on the top 58 of the planar member 46, with which they preferably are integral, and the planar member is made substantially thicker than would be necessary for structural reasons, for purposes to be explained.

One, and preferably two, side edges of the planar member protrude as straightedges 60, 62 parallel with the sides and perpendicular to the ends, for drafting alignment or other alignment purposes, each preferably has a bevel 64 downward to the straightedge. The bevel may have along it one or more conventional scales 65.

Each array of prisms is fixed at a predetermined angle to the straightedges. In space 32, prism array 50 extends diagonally from upper left to lower right, preferably, for customary drafting purposes, at a thirty degree angle.

In space 34, prism array 52 extends diagonally from lower left to upper right, preferably at a thirty degree angle, for customary drafting purposes.

In space 36, prism array 54 extends from upper left to lower right, at preferably a forty-five degree angle for customary drafting purposes.

The angles in spaces 32, 34 and 36 could all be in opposite direction if desired.

In space 38, prism array 56 extends parallel with the straightedges.

The arrays in spaces 32 and 34 are shown with two prisms each and the arrays in spaces 36 and 38 with three prisms each. Relative prism size and angle determine how many prisms can be fitted in a space. For reasons of enhances apparent line offset relatively large prisms are preferred. These preferably are arranged for maximizing the field of view, extending sustantially across the planar member. Optionally, the exact angular alignment of the prism arrays could be other than 30, 45, 60, 180 degrees to the straightedge to suit particular needs.

For a representative embodiment as shown, dimensions may be:

length- 30 cm
height O.A.- 2.2 cm
width O.A.- 5.1 cm
width of frame- 4 cm
thickness of planar member- 0.6 cm
space dimenions:
length- 7 cm
width- 2.7 cm
height- 1.3 cm
prism sectional dimensions:
width, each face- 1.3 cm In operation, when a prism apparatus, for instance array 50 of prisms, is aligned at any angle other than perpendicular or parallel (ninety degrees or one hundred eight degrees) to a straight line L, portions $0_1$, $0_2$, $0_3$, $0_4$ of the straight line appear offset and discontinuous as a function of the angle. The user has only to re-orient the frame and thus the prism array 50 until no offset appears, to assure that the prisms employed are perpendicular to the line being observed, producing by virtue of the angle between the selected array and the straightedge the desired angular relation of straightedge to line L, in this case thirty degrees clockwise. Line $L_1$ shows the final alignment.

In the preferred embodiment shown with each prism effectively providing back-to-back optical wedges, the offsets ($0_1$, $0_2$, $0_3$, $0_4$, for example) will alternate, as shown, doubling the sensitivity.

If the prism faces are not flat but, as an example, are in sectional aspect slightly convex, the offsets appear curved, providing a further enhancement of indication of misalignment. The line being observed can, in spite of such curvature, still pass through any portion of the length of the array without need for special location, because the prisms are still straight longitudinally.

Prism array 52 is shown with a line misaligned, at L, with offsets in it, and with the same line $L_1$ viewed correctly oriented at thirty degrees counterclockwise to the straightedges 60, 62, after the user re-orients the frame.

Prism array 54 is shown with a line misaligned, at L, with offsets in it, and the same line $L_1$ viewed correctly oriented at forty-five degrees clockwise to the straightedges after the user re-orients the instrument. If desired, a second array for orienting a line at forty-five degrees counterclockwise to the straightedges, may be provided, but this is not essential.

Prism array 56 is shown with a line misaligned, at L, with offsets in it, and the same line $L_1$ viewed correctly oriented perpendicular to the straightedges, with no offsets, after re-orientation of the instrument by the user.

Through a combination of use of the forty-five degree array 54 and the perpendicular or ninety degree array 56, the instrument can be used to draw a forty-five degree angle in any quadrant of the drawing surface, working from a given line and a line at right angles to it, as necessary.

As mentioned, the prism bases preferably rest on the planar member 46, which member is substantially thicker than it would otherwise need to be for structural considerations. The additional thickness is to raise the prisms a substantial distance above the surface on which the reference line is marked. This raising of the prisms is a means of disconnecting both ends of each offset line portion from the remainder of the reference line, enhancing the indication of misalignment. The disconnected offset appearance is produced, as shown in FIG. 1, also at the base angles of the prisms instead of merely at the vertex angle as would otherwise be the appearance.

If the prism bases were resting on, or were proximately at, the surface bearing the reference line, the offset would appear as a connected oblique deflection at each base angle extending to a disconnection at the vertex angle.

It is apparent that the planar member could support the prisms above the working surface a distance such that the offset at the prism base angles would be unnoticeable, and still be structurally strong enough, but this is not the intent of the invention.

Figure 4A:
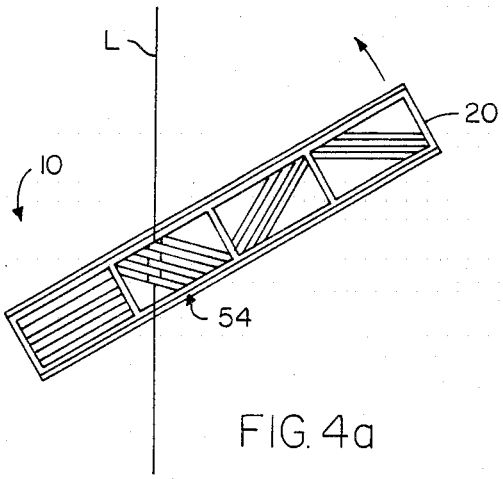
FIG. 4*a*, 4*b* and 4*c* illustrate in plan view an example of use.
Figure 4B:
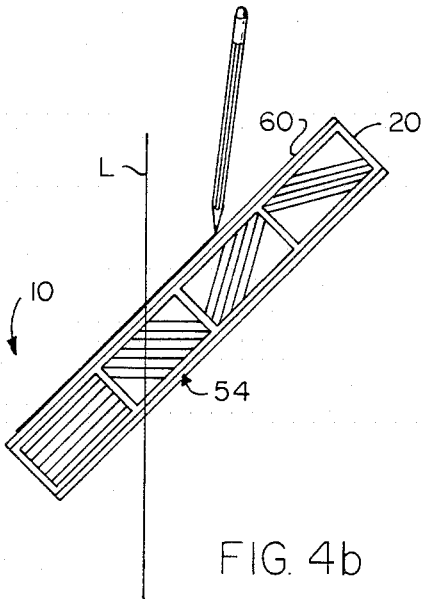
Figure 4C:
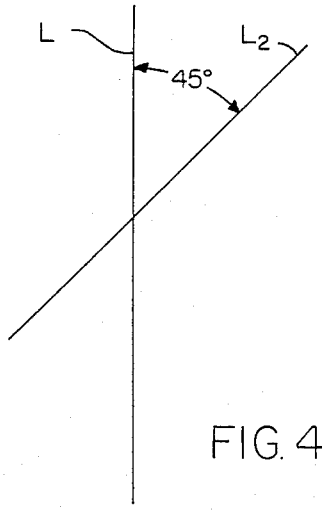

FIGS. 4*a*, 4*b* and 4*c* show a sequence in alignment of the frame 20 and reference line L. In FIG. 4*a* the user places the instrument over reference line L using a selected prism array, in this case 45 degree array 54. Corrective rotation (arrow) is needed. In FIG. 4*b* the user rotates from 20 (arrow) counterclockwise bringing misaligned disconnected portions of line L as viewed through prism array 54 into visual continuous straight line alignment for drawing line $L_2$. This establishes the desired angle between straightedge 60 and line L. In FIG. 4*c* the result can be seen.

Figure 5:
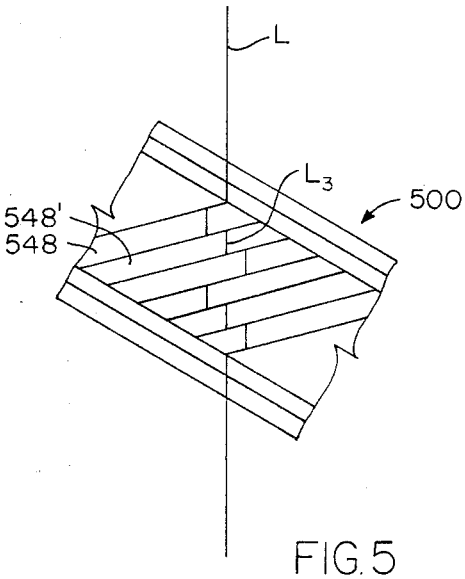
FIG. 5 is a plan view of a fragment of a further embodiment with prisms with truncated apices or vertices.

FIG. 5 shows a fragment of a further embodiment 500 with optional prism configuration. Prism 548 has truncated vertices 548' resulting in additional discontinuity in misaligned portion of the observed reference line L. This provides an additional visual aid in that the portion of the line $L_3$ viewed through the truncated portion is always in alignment with the reference line.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system of prism apparatus on a mount for use in orientation of lines and the like on a surface, as in drafting, by producing, in a field of view, an appearance of offset in a portion of a line when at oblique angles to the prism apparatus, the improvement comprising: the prism apparatus including a plurality of prisms having respective bases, the mount including a planar member with sides and ends and at least one of the sides comprising a straightedge, the plurality of prisms and the planar member being transparent, and the bases of the prisms being affixed in differing predetermined angular relations to the straightedge.

2. In a system as recited in claim 1, means for enhancing said appearance of offset, including said bases of the prisms being affixed a distance above a said surface producing appearance of disconnection of a said offset portion.

3. In a system as recited in claim 2, the plurality of prisms being triangular prisms.

4. In a system as recited in claim 3, the means for enhancing the offset appearance further comprising the plurality of prisms including groups of said prisms being juxtaposed in parallel-aligned arrays.

5. In a system as recited in claim 4, means for maximizing the field of view of at least one group of prisms, including said at least one group of prisms extending substantially across the planar member.

6. In a system as recited in claim 2, means for selectively indicating a lefthand 45° angle and a right hand 45° angle in said predetermined angular relations, including at least one of said prisms being at an angle of 45° to said straightedge, and at least one of said prisms being parallel to said straightedge.

7. In a system as recited in claim 6, said predetermined angular relation including at least one of said prisms being at a clockwise 30° angle to said straightedge, at least one of said prisms being at a counterclockwise 30° angle to said straightedge.

8. In a system as recited in claim 2, said planar member having a straightedge extending laterally beyond said prisms.

9. In a system as recited in claim 8, said straightedge being in the form of a bevelled edge of the planar member along a said side.

10. In a system as recited in claim 9, a said bevelled edge on each side of the planar member.

11. In a system as recited in claim 2, said prisms being in, and part of, a transparent molded housing.

12. In a system as recited in claim 11, and a transparent cover on said transparent molded housing.

13. In a system as recited in claim 1, means for enhancing said appearance of offset, comprising said planar member being of a thickness substantially greater than necessary for imparting structural strength and stiffness to the planar member, and the bases of the prisms being on the planar member.

14. In a system as recited in claim 3, the plurality of prisms including at least one prism with truncated vertex.

* * * * *